US008844946B2

(12) United States Patent
Lorelli

(10) Patent No.: US 8,844,946 B2
(45) Date of Patent: Sep. 30, 2014

(54) ROTATING ASSEMBLY

(76) Inventor: Elizabeth A. Lorelli, Washington, DC (US)

( * ) Notice: Subject to any disclaimer, the term of this patent is extended or adjusted under 35 U.S.C. 154(b) by 0 days.

(21) Appl. No.: 13/480,986

(22) Filed: May 25, 2012

(65) Prior Publication Data

US 2013/0313793 A1 Nov. 28, 2013

(51) Int. Cl.

| | |
|---|---|
| ***A63C 17/02*** | (2006.01) |
| ***A63C 17/04*** | (2006.01) |
| ***A63C 17/06*** | (2006.01) |

(52) U.S. Cl.

USPC ..... 280/11.27; 280/11.19; 280/11.28

(58) Field of Classification Search

USPC ..... 280/11.28, 81.5, 11.19, 11.27

See application file for complete search history.

(56) References Cited

U.S. PATENT DOCUMENTS

| | | | | |
|---|---|---|---|---|
| 2,719,724 | A * | 10/1955 | Lundgren | 280/11.223 |
| 4,382,605 | A | 5/1983 | Hegna | |
| 5,140,720 | A * | 8/1992 | Sisler | 16/35 D |
| 5,183,277 | A * | 2/1993 | Tang | 280/11.28 |
| 5,494,304 | A * | 2/1996 | Levy et al. | 280/11.209 |
| 6,105,977 | A | 8/2000 | Bengtsson et al. | |
| 6,206,390 | B1 * | 3/2001 | Borg | 280/87.042 |
| 6,213,479 | B1 * | 4/2001 | Cochimin | 280/7.1 |
| 6,764,082 | B2 | 7/2004 | Roderick | |
| 2002/0060433 | A1 * | 5/2002 | Cochimin | 280/11.19 |
| 2005/0006859 | A1 | 1/2005 | Farrelly et al. | |

* cited by examiner

*Primary Examiner* — Hau Phan
*Assistant Examiner* — Bryan Evans
(74) *Attorney, Agent, or Firm* — Wiggin and Dana LLP; Anthony P. Gangemi

(57) ABSTRACT

A synchronized rotating wheel assembly for a recreational device having wheels is disclosed. The assembly includes a base plate having top and bottom surfaces, the top surface of the base plate adapted to be attached to a portion of the recreational device, a gear assembly joined with the bottom surface of the base plate, and first and second wheel assemblies respectively joined with the first and second interconnected gears. The gear assembly includes first and second interconnected gears, a mechanism for rotating the first and second gears in unison and in the same direction, and a bias spring mechanism for returning the first and second interconnected gears to a default position when the gear assembly is not under stress. The mechanism may include a third gear between the first and second interconnected gears or a belt having teeth that cooperate with both the first and second interconnected gears.

3 Claims, 5 Drawing Sheets

ROTATING ASSEMBLY

BACKGROUND OF THE INVENTION

The disclosed subject matter generally relates to a rotating assembly. In particular, some embodiments of the disclosed subject matter are directed to a rotating base plate assembly that allows the wheel assemblies of wheeled recreational devices such as in-line skates and skateboards to rotate while returning them to a default position when not under stress. Other embodiments include the attachment of blades, skis, or other non-wheel assemblies.

Attempts have been made to develop human-powered, dry land devices that mimic the motion and feel of snowboarding, surfing, etc. Some of the attempts include independent skateboard-like platforms attached to in-line wheels, roller skate wheel assemblies that rotate and cause one another to rotate opposite of the other, and in-line skate wheel assemblies that include independently rotating wheels.

None of the prior devices includes a proper interaction between front and back wheel assemblies and none of the prior devices allow for proper rotation of wheel assemblies. As a result, none of the prior devices has been found to both effectively allow a sideways motion necessary for simulating snowboarding and/or surfing and include aspects of conventional wheeled skates with disconnected feet.

BRIEF SUMMARY OF THE INVENTION

One aspect of the present invention is a synchronized base plate assembly for a recreational device having wheels, which includes the following: a base plate having top and bottom surfaces, the top surface of the base plate adapted to be attached to a portion of the recreational device; a gear assembly joined with the bottom surface of the base plate, the gear assembly including first and second interconnected gears, a mechanism for rotating the first and second gears in unison and in the same direction, and a bias spring mechanism for returning the first and second interconnected gears to a default position when the gear assembly is not under stress; and first and second wheel assemblies respectively joined with the first and second interconnected gears.

Another aspect of the invention is a synchronized rotating base plate assembly for a recreational device, which includes the following: a base plate having top and bottom surfaces, the top surface of the base plate adapted to be attached to the recreational device; and a gear assembly joined with the bottom surface of the base plate, the gear assembly including first and second gears that are interconnected via one of a third gear and a belt, and a bias spring mechanism for returning the first and second interconnected gears to a default position when the gear assembly is not under stress. The first and second gears are interconnected to rotate in unison and in the same direction.

Still another aspect of the invention is a rotating base plate assembly for a recreational device, which includes the following: a base plate having top and bottom surfaces, the top surface adapted to be joined with the recreational device; and a rotatable mounting assembly joined with the bottom surface of the base plate, the rotatable mounting assembly including a rotatable disk and a bias spring mechanism joined with the rotatable disk. The bias spring mechanism causes the rotatable disk to return to a default position when not under stress.

Another aspect of the invention is a recreational device, which includes the following: separate left and right boots each including bottom surfaces; and rotating wheel assemblies mounted with the bottom surfaces, the assemblies configured to rotate to a first position with respect to a longitudinal axis of the boots and the assemblies configured to return to a default, second position that is in-line with the longitudinal axis when not under stress.

BRIEF DESCRIPTION OF THE DRAWINGS

For the purpose of illustrating the invention, the drawings show embodiments of the disclosed subject matter. However, it should be understood that the present application is not limited to the precise arrangements and instrumentalities shown in the drawings, wherein.

DETAILED DESCRIPTION

Figure 1:
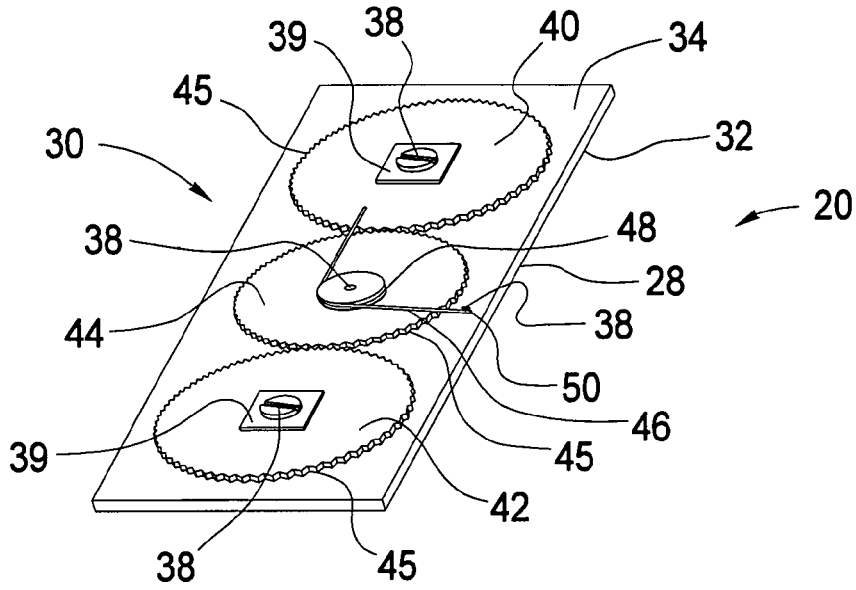
FIG. 1 is an isometric view of a synchronized rotating base plate assembly according to one embodiment of the present invention.

Referring now to the drawings in which like reference numerals indicate like parts, and in particular, to FIGS. 1-6, one aspect of the present invention is a synchronized rotating base plate assembly 20. Synchronized rotating base plate assembly 20 may be used with recreational devices having wheels such as traditional roller skates, in-line skates, skateboards, or similar devices, to allow a user to manipulate a portion of the device in contact with the user, e.g., a skate boot 22, to rotate substantially independent of a portion of the device in contact with a ground surface, e.g., first and second wheel assemblies 24 and 26, respectively, while also ensuring that each of the wheel assemblies rotates both in-synch and in the same direction.

Synchronized rotating base plate assembly 20 generally includes base plate 28 joined with the portion of the device in contact with the user, e.g., skate boot 22, and joined with a gear assembly 30, which is joined with the portion of the device in contact with the ground surface, e.g., first and second wheel assemblies 24 and 26.

Base plate 28 includes a top surface 32 and an opposite bottom surface 34. Top surface 32 is typically joined with and adhered to a bottom surface 36 of the portion of the device in contact with the user, e.g., skate boot 22, using screws 38 or the like.

Gear assembly 30 is typically joined with bottom surface 34 of base plate 28 using screws 28 and washers 39 or the like. Gear assembly 30 generally includes first and second interconnected gears 40 and 42, respectively, and a third gear 44 positioned between and engaged with the first and second interconnected gears. Third gear 44 translates rotation of each of first and second interconnected gears 40 and 42 to the other via the engagement of gear teeth 45. For example, if first gear 40 rotates in a clockwise direction, third gear 44 will be cause to rotate in a counter-clockwise direction, which will cause second gear 42 to rotate in a clockwise direction, e.g., with respect a longitudinal axis A1 of boot 22. The configuration of gear assembly 30 ensures that first and second gears 40 and 42 rotate both in unison and in the same direction. Gear assembly 30 typically includes a bias spring mechanism 46 for returning said first and second interconnected gears 40 and 42 to a default position when the gear assembly is not under stress. Bias spring mechanism 46 is generally wound around a raised portion 48 of third gear 44 and fixed at an end 50 to base plate 28 via screw 38 or the like. In the case of an in-line skate, if a user lifts skate boot 22 so that wheel assemblies 24 and 26 are suspended and not in contact with a ground surface, tension in bias spring mechanism 46 is released thereby causing both it and third gear 44 to return to a default position, which in turn will cause both first and second gears 40 and 42 to return to a default position.

Figure 5:
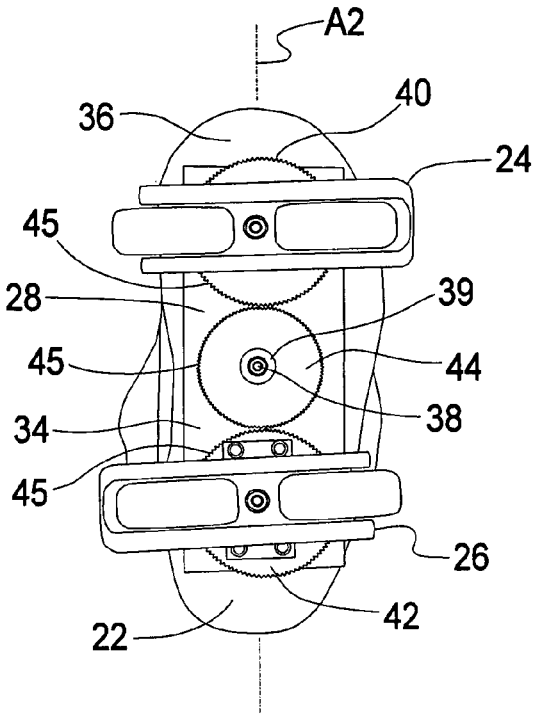
FIG. 5 is a bottom view of an in-line skate having a synchronized rotating base plate assembly according to one embodiment of the present invention.
Figure 6:
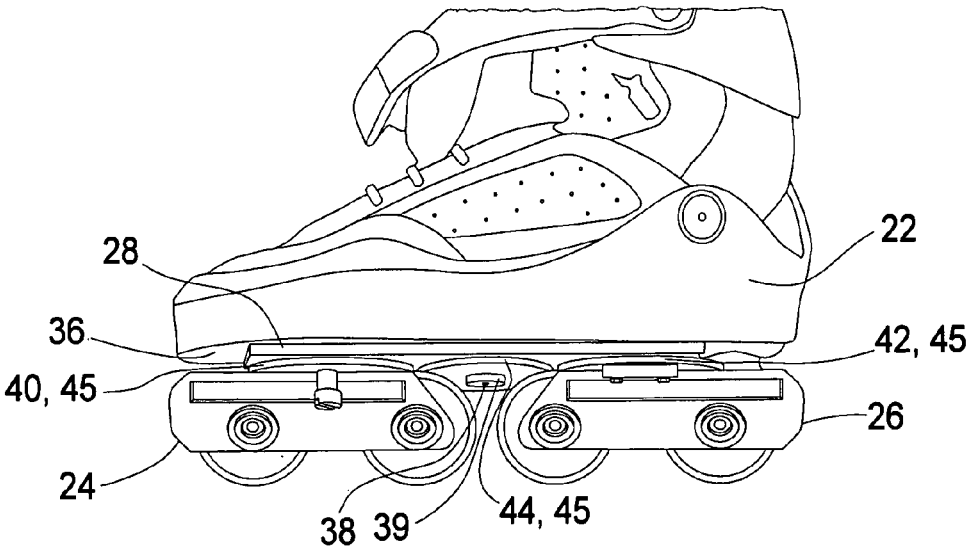
FIG. 6 is a side view of an in-line skate having a synchronized rotating base plate assembly according to one embodiment of the present invention.

As illustrated in FIGS. 5 and 6, first and second wheel assemblies 24 and 26 may be of the type that are commonly available and known in the prior art. Generally, first and second wheel assemblies 24 and 26 are mounted to first and second gears 40 and 42, respectively, using screws 38 or the like. As shown in FIG. 6, in one position, wheel assemblies 24 and 26 are not rotated, i.e., are in-line, and appear to be identical to a conventional in-line skate. However, as shown in FIG. 5, in a second position, wheel assemblies 24 and 26 are rotated about 90 degrees (or other varying degrees of rotation), so as to form a skate that can move in a sideways direction with respect to a heal to toe axis A2 of the respective skate boot 22.

Figure 2:
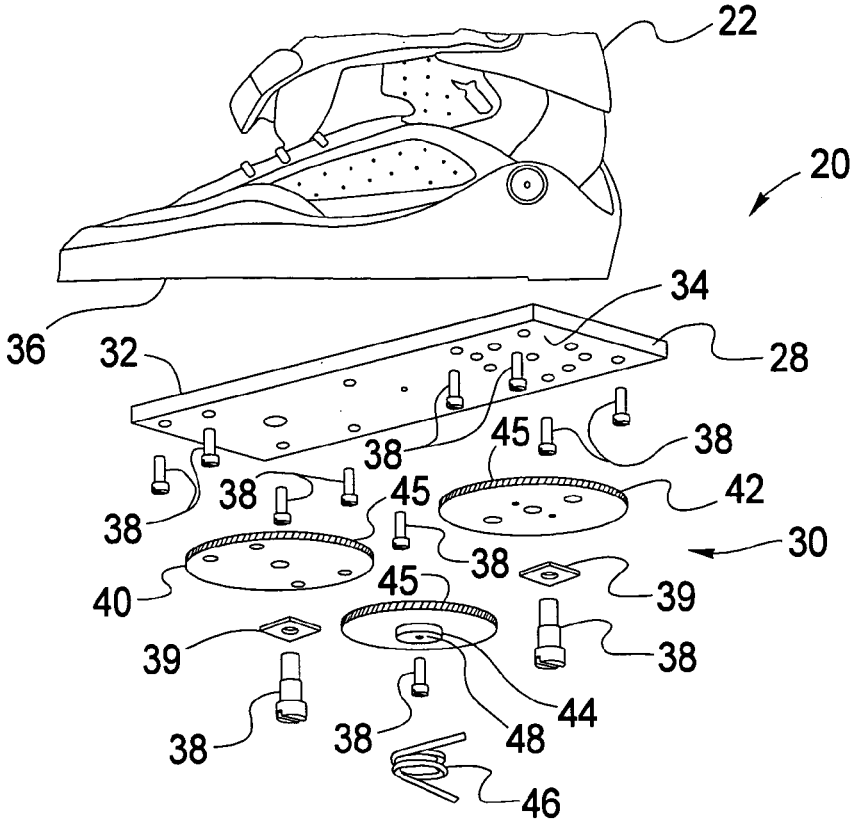
FIG. 2 is an exploded view of the assembly in FIG. 1 and a skate boot.
Figure 3:
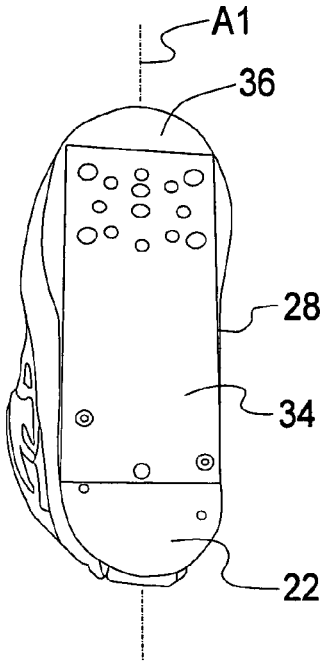
FIG. 3 is a plan view a base plate mounted to the bottom surface of a skate boot according to one embodiment of the present invention.
Figure 4:
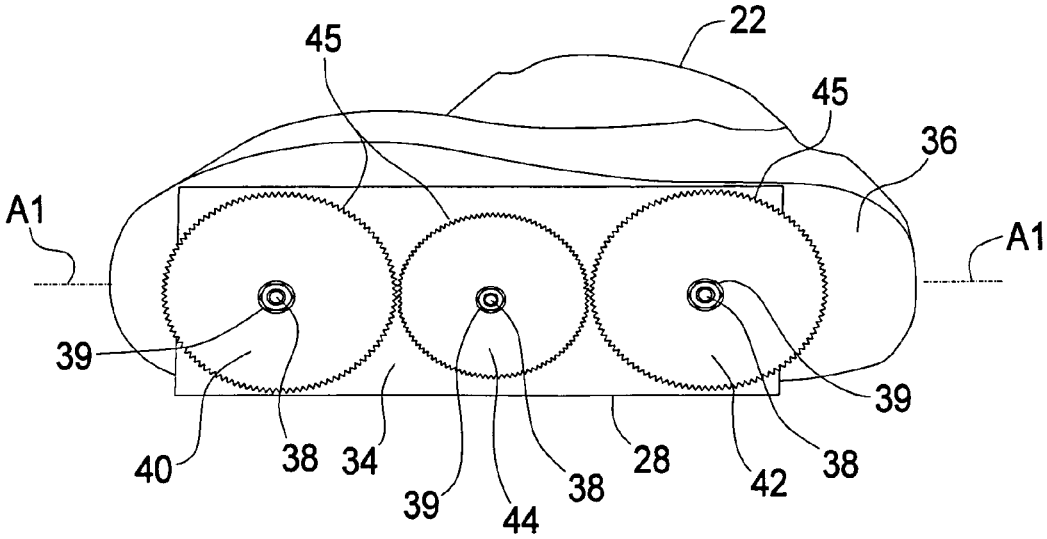
FIG. 4 is an isometric view of a base plate including a gear assembly according to one embodiment of the present invention.

Wheel assemblies 24 and 26 can be "locked" into a particular angle/position as chosen by a user/rider, e.g., in a "sideways" position, the rider can select their desired "stance", just as snowboarders can select from various angles to place their feet. Referring to FIGS. 2, 3, and 6, screw 38 is inserted into one of a circle of holes H to fix or lock gears 40 and 42 and thus wheel assemblies 24 and 26 into a desired position. In addition to the use of a screw or pin, various different ways to fix or lock the wheels are contemplated. Also, as mentioned above, instead of locking the wheels, in some embodiments, a spring forces the wheels to stay essentially straight but have a little bit of "give", e.g., similar to snowboarding because of the powder or ice feel. In some embodiments, the spring forces the wheels to a chosen angle or to in-line. In some embodiments, the wheels rotate in such a way that certain wheels, e.g., the end ones, in one embodiment, lift off the ground or the two trucks come closer together, e.g., in a "training wheels" version.

Figure 7:
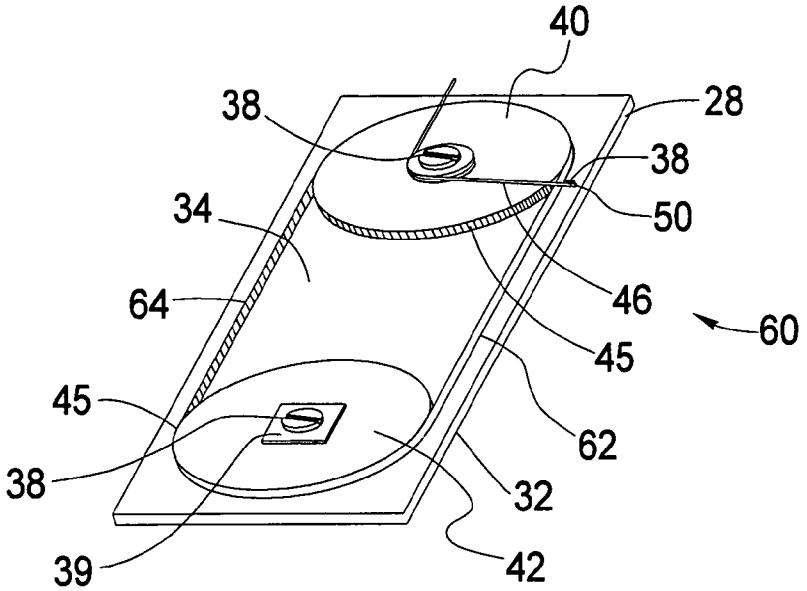
FIG. 7 is a an isometric view of a synchronized rotating base plate assembly according to one embodiment of the present invention.
Figure 8:
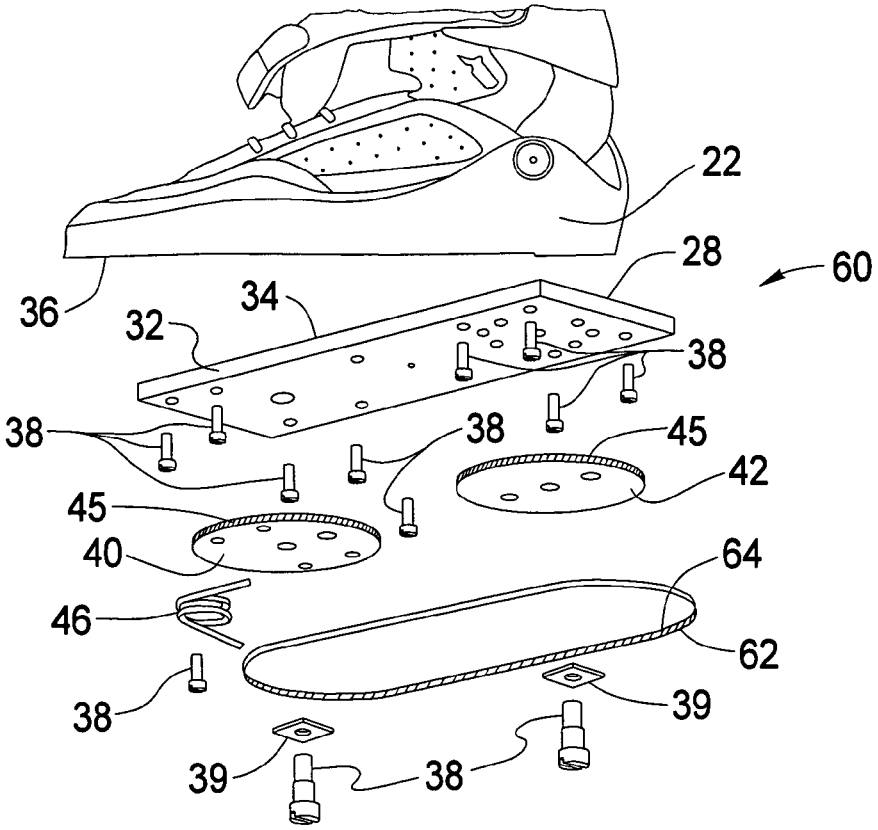
FIG. 8 is an exploded view of the assembly in FIG. 7 and a skate boot.

Referring now to FIGS. 7 and 8, another embodiment of the invention includes a synchronized rotating base plate assembly 60, which is substantially the same as synchronized rotating base plate assembly 60 with the exception of third gear 44. For synchronized rotating base plate assembly 60, instead of a third gear 44 to interconnect first and second gears 40 and 42, a belt 62 translates rotation of each of first and second interconnected gears 40 and 42 to the other. Belt 62 is wrapped around first and second interconnected gears 40 and 42 and includes teeth 64 that cooperate with gear teeth 45 of both gears. In use, if first interconnected gear 40 rotates, belt 62 is caused to rotate, and in turn, second interconnected gear 42 is caused to rotate, and vice versa.

Figure 9:
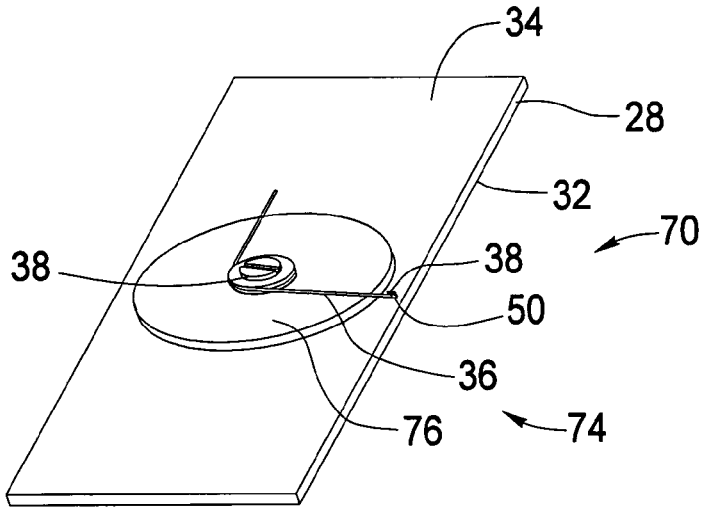
FIG. 9 is a is a an isometric view of a synchronized rotating base plate assembly according to one embodiment of the present invention.
Figure 10:
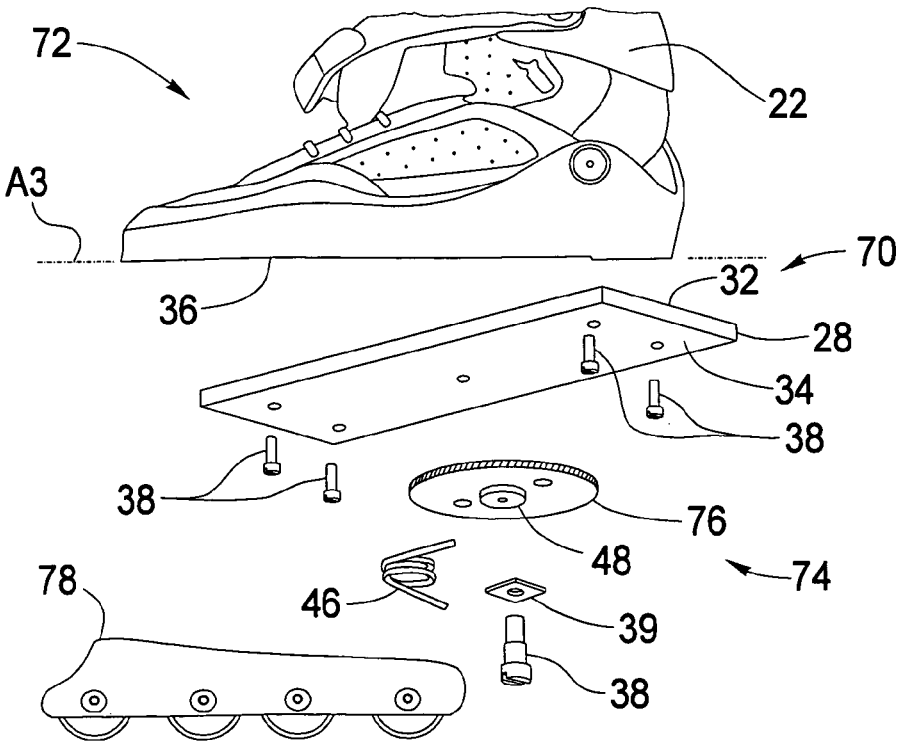
FIG. 10 is an exploded view of the assembly in FIG. 9 and a skate boot.

Referring now to FIGS. 9 and 10, another embodiment of the invention includes a rotating base plate assembly 70 for use with a recreational device, e.g., traditional roller skate, an in-line skate 72, skateboard, etc. Rotating base plate assembly 70 shares elements common to synchronized rotating base plate assemblies 20 and 60 as indicated by like element numbers. In contrast to synchronized rotating base plate assemblies 20 and 60, instead of a gear assembly, rotating base plate assembly 70 includes a rotatable mounting assembly 74, which typically includes only a rotatable disk 76 that is joined with bottom surface 34 of base plate 28 via a screw 38 and washer 39 or the like. Rotatable disk 76 is joined with a wheel assembly 78. In some embodiments, a combined wheel assembly/rotatable disk, e.g., dual-functionality wheel truck, is utilized to further simplify fabrication and assembly of the plate assembly. Bias spring mechanism 46 is generally wound around a raised portion 48' of rotatable disk 76 and fixed at an end 50 to base plate 28 via screw 38 or the like. When tension in bias spring mechanism 46 is released, rotatable disk 76 is returned to a default position, which in turn causes wheel assembly 78 to return to a default position. Similar to the embodiment describe above with respect to FIGS. 5 and 6, in a first position, wheel assembly 78 is not rotated, i.e., is in-line, and appears to be identical to a conventional in-line skate. However, in a second position, wheel assembly 78 is rotated about 90 degrees (or other varying degrees of rotation), so as to form a skate that can move in a sideways direction with respect to a heal to toe axis A3 of the respective skate boot 22.

The present invention offers advantages over prior art designs. Designs according to the disclosed subject matter allow skateboard-like skating but with more freedom than in traditional methods, while also allowing for typical "in-line" skating, e.g., it would allow one to "snowboard" downhill and then in-line skate back up-hill. It is practical for asphalt where the high-friction nature of the surface makes for challenges in regards to maneuverability. In addition to allowing for tighter and more creative turns, it can also be used as a normal "straight" skate.

Aspects of the disclosed subject matter allow a user to self-propel in multiple directions, including both the in-line stance and "skateboard" stance. This allows for the unique opportunity to "skateboard" downhill, but more easily get back uphill, maneuver around flatter ground, or generally gain more speed than in the other current methods. Although the invention has been described and illustrated with respect to exemplary embodiments thereof, it should be understood by those skilled in the art that the foregoing and various other changes, omissions and additions may be made therein and thereto, without parting from the spirit and scope of the present invention. Accordingly, other embodiments are within the scope of the following claims.

What is claimed is:

1. A synchronized rotating base plate assembly for a recreational device having wheels, comprising:

a base plate having top and bottom surfaces, said top surface of said base plate adapted to be attached to a portion of said recreational device;

a gear assembly joined with said bottom surface of said base plate, said gear assembly including first and second interconnected gears, means for rotating said first and second gears in unison and in the same direction, and a bias spring mechanism for returning said first and second interconnected gears to a default position when said gear assembly is not under stress; and first and second wheel assemblies respectively joined with said first and second interconnected gears;

wherein said first and second interconnected gears are configured to be releasably locked at a position that causes said first and second wheel assemblies to be rotated about ninety degrees from a first position where said first and second interconnected gears are in said default position, which allows said first and second wheel assemblies to move in a sideways direction with respect to a heal to toe axis of said recreational device.

2. A synchronized rotating base plate assembly according to claim 1, wherein said means for rotating includes a third gear between said first and second interconnected gears, said third gear translating rotation of each of said first and second interconnected gears to the other.

3. A synchronized rotating base plate assembly according to claim 1, wherein said portion of said recreational device is a skate boot.

* * * * *